US006824077B2

(12) United States Patent
De Laforcade

(10) Patent No.: US 6,824,077 B2
(45) Date of Patent: Nov. 30, 2004

(54) DISPENSER HEAD HAVING TWO NOZZLES

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 155 days.

(21) Appl. No.: 10/197,907

(22) Filed: Jul. 19, 2002

(65) Prior Publication Data

US 2003/0025001 A1 Feb. 6, 2003

(30) Foreign Application Priority Data

Jul. 20, 2001 (FR) ..... 01 09739

(51) Int. Cl.[7] ..... A62C 11/00; B05B 9/043; B05B 7/32; F23D 11/24; F23D 14/28

(52) U.S. Cl. ..... 239/333; 239/337; 239/543; 239/492; 239/600; 222/402.13; 222/485

(58) Field of Search ..... 239/333, 337, 239/543, 492, 600, 302, 329, 331, 468, 469, 490, 544, 545, 553, 548, 553.3, 553.5; 222/402.13, 485

(56) References Cited

U.S. PATENT DOCUMENTS

| | | | | |
|---|---|---|---|---|
| 2,994,483 A | | 8/1961 | Christian | |
| 3,045,925 A | | 7/1962 | Giangualano | |
| 3,406,913 A | | 10/1968 | Frangos | |
| 3,628,733 A | | 12/1971 | Kahn | |
| 4,096,997 A | * | 6/1978 | Larson | 239/413 |
| 4,247,049 A | | 1/1981 | Gailitis | |
| 4,322,037 A | | 3/1982 | Heeb et al. | |
| 4,568,002 A | | 2/1986 | Weinstein et al. | |
| 4,783,008 A | * | 11/1988 | Ikeuchi et al. | 239/421 |
| 5,147,087 A | | 9/1992 | Fuchs | |
| 5,211,317 A | | 5/1993 | Diamond et al. | |
| 5,236,127 A | * | 8/1993 | Ohnishi et al. | 239/346 |
| 5,337,926 A | | 8/1994 | Drobish et al. | |
| 5,516,045 A | | 5/1996 | Baudin | |
| 5,622,318 A | | 4/1997 | Bougamont et al. | |
| 5,735,465 A | | 4/1998 | Laforcade | |
| 5,743,440 A | | 4/1998 | De Laforcade | |
| 5,785,250 A | | 7/1998 | De Laforcade | |
| 6,234,698 B1 | | 5/2001 | De Laforcade | |
| 6,419,168 B1 | * | 7/2002 | Thieleke et al. | 239/337 |

FOREIGN PATENT DOCUMENTS

| | | |
|---|---|---|
| EP | 0249186 | 12/1987 |
| EP | 0734781 | 10/1996 |
| EP | 0755878 | 1/1997 |
| FR | 2691383 | 11/1993 |
| GB | 1260616 | 1/1972 |
| GB | 2153444 | 8/1985 |
| JP | 60-124659 | 8/1985 |
| JP | 10-137634 | 5/1998 |

OTHER PUBLICATIONS

U.S. patent application Ser. No. 09/236,650, filed Jan. 26, 1999, allowed.

* cited by examiner

*Primary Examiner*—Michael Mar
*Assistant Examiner*—Darren Gorman
(74) *Attorney, Agent, or Firm*—Oblon, Spivak, McClelland, Maier & Neustadt, P.C.

(57) ABSTRACT

A dispenser head includes a body defining two housings, which receive a respective nozzle-carrier provided with a nozzle. Each of the housings communicates with the outside via a first opening and via a second opening. Each nozzle-carrier communicates with a feed duct after being inserted in one of the housings via one of the first openings. The substance is dispensed through the second openings.

62 Claims, 5 Drawing Sheets

DISPENSER HEAD HAVING TWO NOZZLES

CROSS-REFERENCE TO RELATED APPLICATIONS

This document claims priority to French Application No. 0109739 filed Jul. 20, 2001, the entire content of which is hereby incorporated by reference.

BACKGROUND OF THE INVENTION

1. Field of the Invention

The present invention relates to a novel dispenser head for generating a spray. The dispenser can be fitted on a receptacle or on a pump.

2. Description of the Background

Dispenser heads with two nozzles are known. The nozzles can have swirling channels or simple orifices. Patent application GB-A-2 153 444 describes a dispenser head having two nozzles with simple orifices. The jets emitted are directional, so that the emitted particles fragment where the particles meet. Each nozzle is fixed on a nozzle carrier, which is in the form of an angled tube. Such a dispenser head is relatively fragile and unattractive in appearance.

European patent EP-B-O 755 878 describes a dispenser head having two nozzles with swirling channels. In one embodiment, the nozzles are connected by flexible tubes to the body of the head, which gives it a futuristic appearance but which complicates the manufacture. In another embodiment, each nozzle is fixed on a nozzle-carrier, which is snap-fastened fastened at one end in a housing provided in the body of the head. Such an assembly is relatively fragile.

Application FR-A-2 691 383 discloses a dispenser head in which the two nozzles are implemented in the form of a single part. Although such a structure is stronger, and makes unmolding operations easier, it does not easily provide a dispenser head in which the sprays emitted by the nozzles converge at an angle that may exceed 40°, for example. A large angle can lower the kinetic energy of the jets and produce a softer spray, which is desirable in certain applications.

SUMMARY OF THE INVENTION

Consequently, there exists a need for a novel dispenser head which is both strong and economical to manufacture. There is also a need for a dispenser in which the angle between the axes of the nozzles can be greater than 40° when such an arrangement is desired.

The present invention can satisfy the above needs and provides a number of additional advantageous features. A preferred embodiment of the invention includes a dispenser head with a body defining two housings each configured to receive a nozzle-carrier fitted with a nozzle. Each housing communicates with the outside via a first opening and via a second opening. Each nozzle-carrier is arranged so as to communicate with a feed duct after being inserted via the first opening. A substance can be delivered through the second opening. The first openings can be side openings and the second openings can be front openings.

The dispenser head of the invention is particularly robust and pleasing in appearance while being relatively simple to manufacture. This is the case even when the axes of the nozzles are at an angle of more than 40° to each other. In a particular embodiment, the housings are made in a pushbutton and the pushbutton is connected via a hinge-forming portion to an assembly skirt. In a preferred embodiment, the nozzles include swirl or swirling channels. Each feed duct with which a nozzle-carrier communicates can open out into the corresponding housing via a male endpiece, or via a female endpiece. Advantageously, the feed ducts can be radial, thereby facilitating unmolding.

The above-mentioned first openings can be made in a circularly cylindrical wall, the second openings can be made in a generally planar wall. Although these configurations are utilized in a preferred embodiment, it is to be understood that other configurations are also possible. According to a preferred embodiment of the invention, each nozzle-carrier can have a truncated angle portion shaped to be positioned behind and in contact with an upright separating the first opening from the corresponding second opening.

In a particular embodiment, each nozzle-carrier has a housing in which a male endpiece of the body of the dispenser head can be engaged so as to form a leaktight fit. In another embodiment, each nozzle-carrier has a male endpiece suitable for engaging in a female endpiece of the body of the dispenser head so as to form a leaktight fit.

In a particular embodiment, each nozzle-carrier has a center post on which a corresponding nozzle may be coupled or fixed. The center post can be surrounded by an annular groove communicating with a connection portion suitable for communicating with one of the above-mentioned feed ducts. The annular groove can communicate with the connection portion via a channel having the same axis as the nozzle. In a particular embodiment, each nozzle-carrier has a circularly cylindrical wall which can fit contiguously in the body of the head.

The feed duct can be connected to an axial duct which opens out to the inside of the assembly skirt via a female endpiece. This female endpiece provides a connection with a rod for controlling a valve or a pump. This valve or pump can be used to control the flow of the substance to be dispensed out of the receptacle.

The present invention can also include a receptacle that is pressurized or fitted with a pump, together with a dispenser head as defined above. The present invention can include a cosmetic product, for example, a deodorant, a hair product (e.g., a hairspray), or a care product on the skin, in particular on raw skin, which can be dispensed from the device.

BRIEF DESCRIPTION OF THE DRAWINGS

A more complete appreciation of the invention and many of the attendant advantages thereof will be readily obtained as the same becomes better understood by reference to the following detailed description when considered in conjunction with the accompanying drawings, in which.

DETAILED DESCRIPTION OF THE PREFERRED EMBODIMENTS

Figure 1:
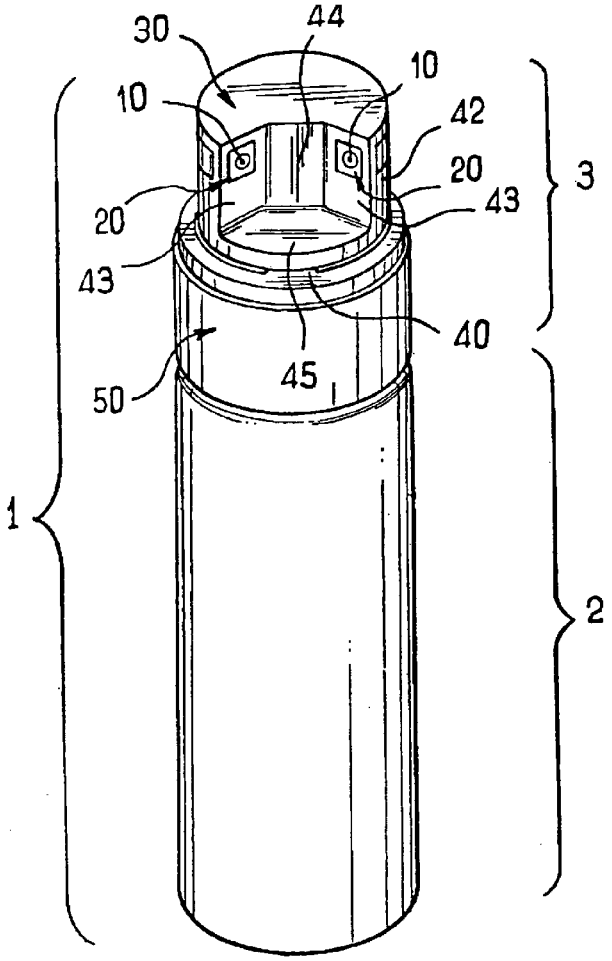
FIG. 1 is a diagrammatic perspective view of a pressurized receptacle fitted with a dispenser head in accordance with one embodiment of the present invention.

FIG. 1 is a diagram showing a packaging and dispenser device 1 in accordance with a preferred embodiment of the-invention. A receptacle 2 is fitted with a dispenser head 3. The receptacle 2 can be pressurized. The top portion of the receptacle 2 has a cup for supporting a valve (not visible). The cup can be crimped onto the body of the receptacle. The valve has a hollow control rod (likewise not visible), and the valve is opened by pushing in the control rod. In another preferred embodiment of the present invention, the pressurized receptacle is replaced by a receptacle fitted with a pump.

The dispenser head 3 has two nozzles 10 held by nozzle-carriers 20 coupled to a pushbutton 30. The pushbutton 30 can be connected via a hinge-forming portion 40 to an assembly skirt 50 used for fixing the assembly to the receptacle 2.

In the non-limiting example illustrated, the pushbutton 30, the hinge-forming portion 40, and the assembly skirt 50 are all made as a one-piece molding of plastics material. However, the various parts could also be formed as separate parts. Together, these elements form the body of the dispenser head.

Figure 2:
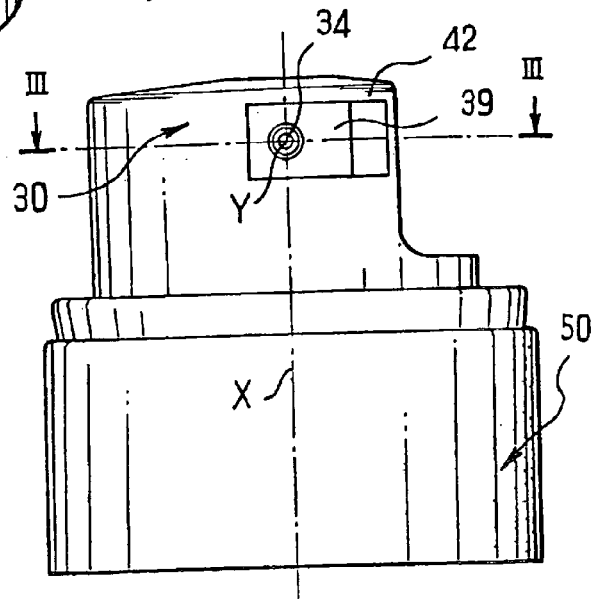
FIG. 2 is a side view of the dispenser head shown in isolation according to a preferred embodiment of the present invention, with the nozzle-carriers removed.
Figure 3A:
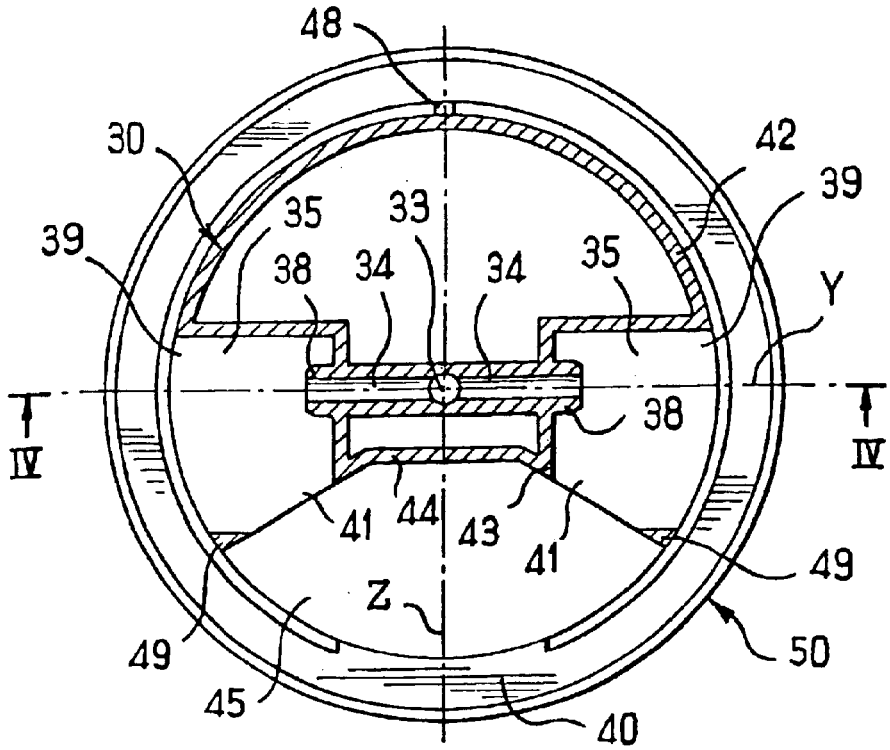
FIGS. 3A–B are cross-sections on III—III of FIG. 2, according to preferred embodiments of the present invention.
Figure 4:
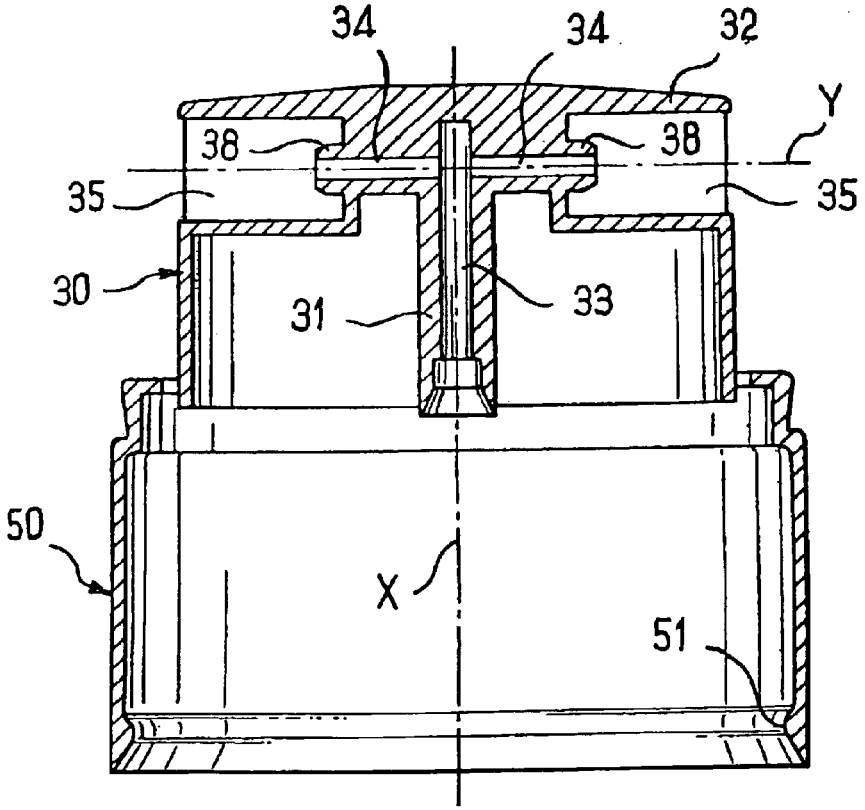
FIG. 4 is an axial section on IV—IV of FIG. 3, according to a preferred embodiment of the present invention.
Figure 3B:
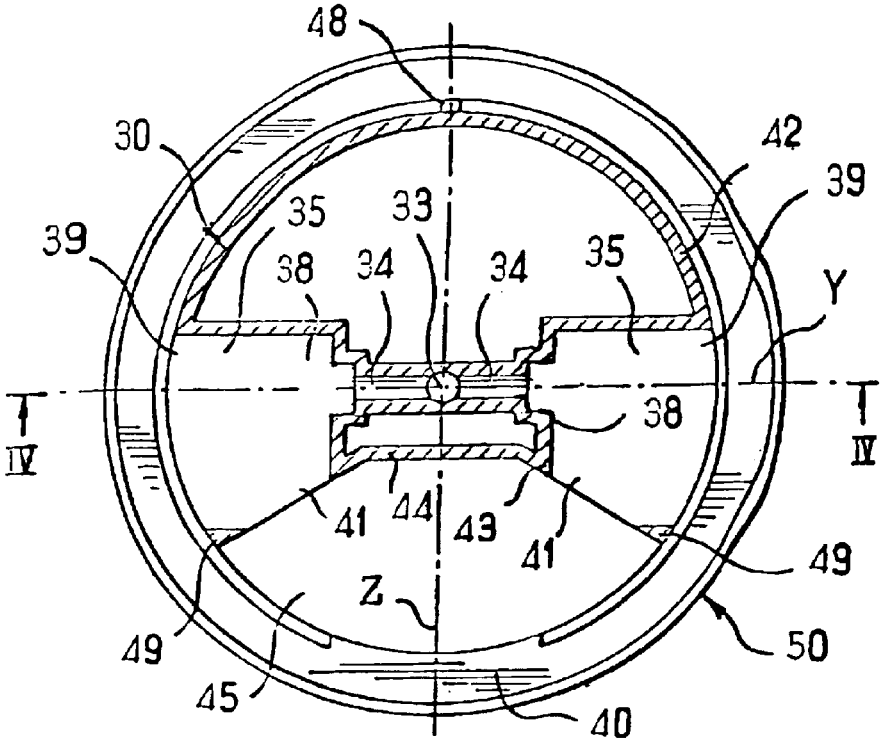

FIGS. 2 to 4 show the body of the dispenser head in isolation without the nozzle-carriers 20, according to a preferred embodiment of the present invention. As shown in FIG. 4, the bottom of the assembly skirt 50 can be provided with a bead 51 projecting radially inwards for snap-fastening in a groove formed in the top portion of the receptacle 2. The pushbutton 30 can have an axial duct 33 on an axis X that opens out, for example, via a female endpiece 31, into the inside of the assembly skirt 50. The axial duct 33 can be configured to receive the top end of the valve control rod to form a leaktight fit.

The duct 33 is connected to two radial feed ducts 34 opening out, for example, via respective male endpieces 38, into the bottoms of housings 35. The housings 35 are configured to receive the nozzle-carriers 20. The ducts 34 can extend in diametrically opposite directions along an axis Y that is perpendicular to the axis X. The housings 35 communicate with the outside via carrier openings 39 and nozzle openings 41. In this non-limiting embodiment, the openings 39 are side openings and the openings 41 are front openings. The side openings 39 are made in a wall 42. In a preferred embodiment, the wall 42 is circularly cylindrical about the axis X of the pushbutton 30. The openings 39 can be generally rectangular in outline, as can be seen in FIG. 2.

The front openings 41 can be made in respective front walls 43. The walls 43 can be generally planar, however, alternate surfaces or shapes are also possible. In a preferred embodiment, the normals of the front walls 43 form an angle between 40° and 100°. Other angles could also be utilized in accordance with the present invention. The two front walls 43 can meet a central wall 44 that extends perpendicularly to an axis Z itself perpendicular to the axes X and Y, as can be seen in FIG. 3. In this non-limiting embodiment, each of the front walls 43 is at an angle of about 30° relative to a plane of the central wall 44 (or about 150° at the front surfaces of the walls). However, other angles could also be used in accordance with the present invention.

The front and central walls 43 and 44 can be connected at their bottoms to a bottom wall 45 extending perpendicularly to the axis X. A bridge 48 of breakable material can optionally connect the cylindrical wall 42 to the top portion of the assembly skirt 50 so as to reduce the risk of the pushbutton 30 being accidentally pushed in prior to first use. This bridge of material 48 can be situated opposite the hinge-forming portion 40. Other locations could also be utilized in accordance with the present invention.

The front and cylindrical walls 43 and 42 can be connected together by uprights 49. The pushbutton 30 has a top wall 32 providing a surface against which the user presses. In order to dispense the substance, the user presses on the top wall 32, thereby pushing down the pushbutton 30 and actuating the valve of the receptacle 2. As can be seen from FIG. 1, the top wall 32 of the pushbutton 30 has the shape of a first section of a disk. The bottom wall 45 has the shape of a second section of a disk. The two sections are complementary, i.e., they form a disk as seen from above the pushbutton 30. In a preferred embodiment, the top wall and the bottom wall are parallel to each other.

Each upright 49 lies between the corresponding front and side openings 41 and 39 and extends between the top and bottom walls 32 and 45. The upright 49 can present a cross-section that is generally triangular, with a major base parallel to the direction Y. During unmolding, the uprights 49 are in contact with two slides of the mold. One of these slides can be moved in the direction Y and the other in the direction Z.

Figure 5B:
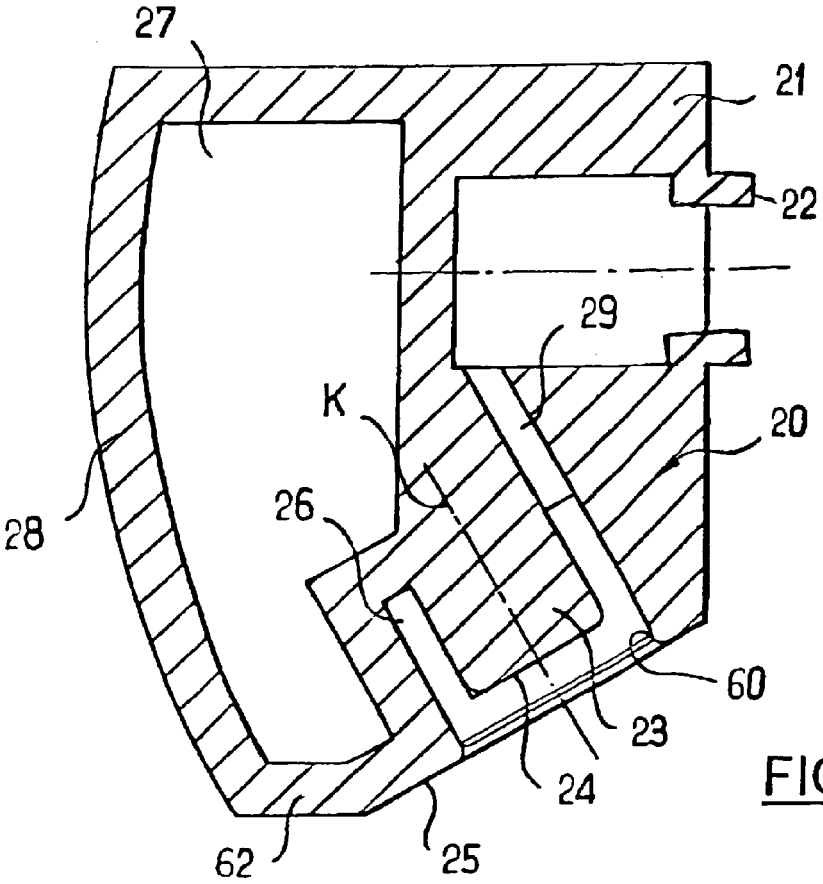
FIGS. 5A–B show a nozzle-carrier in isolation according to preferred embodiments of the present invention, the nozzle being removed.
Figure 5A:
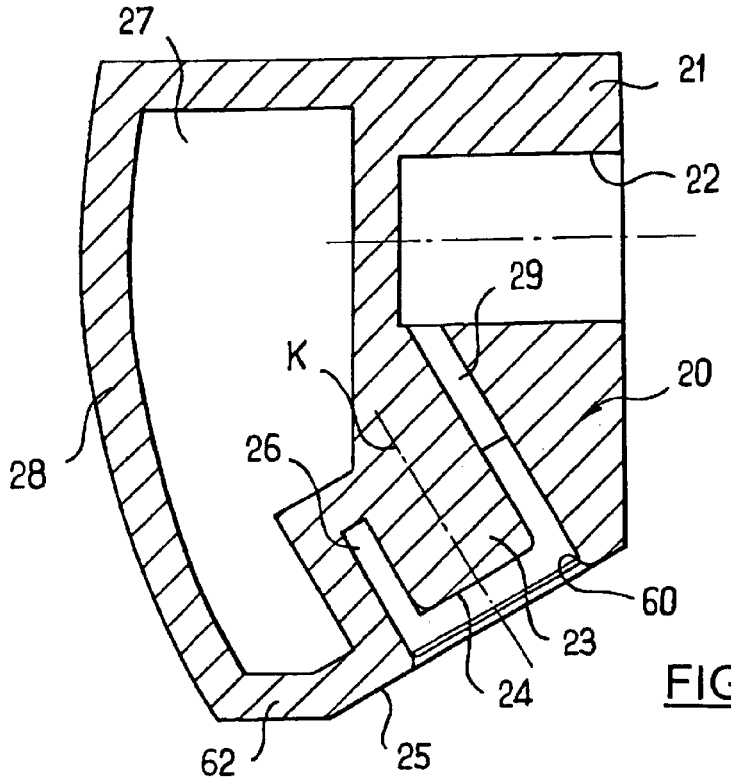

A nozzle-carrier 20 is described below with reference to FIG. 5. The nozzle-carrier includes a body 21. This body 21 can be made, for example, as a one-piece molding of plastics material. Each nozzle-carrier 20 can be made by injecting a thermoplastic material and it is easy to unmold given its shape. The nozzle-carrier 20 defines a housing 22 for receiving one of the above-mentioned male endpieces 38. Preferably, the endpiece 38 forms a leaktight fit with the housing 22. The nozzle-carrier 20 includes a center post 23 (or support rod). The center post 23 can have a front face 24 that extends behind a front face 25 of the nozzle-carrier 20.

Figure 7:
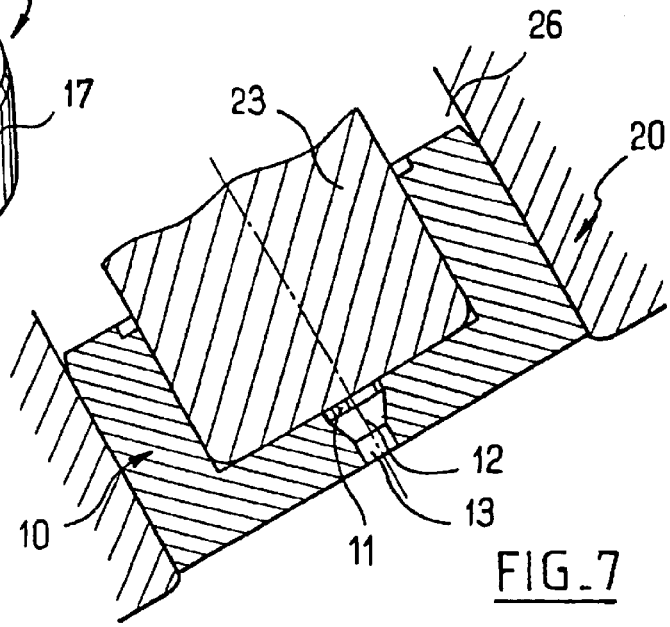
FIG. 7 is a diagrammatic fragmentary section view of a nozzle in place in its nozzle-carrier, according to a preferred embodiment of the present invention.

An annular groove 26 can surround the center post 23 to enable the nozzle 10 to be fixed thereto, as shown in FIG. 7. The axis K of the center post 23 sets the spray axis of the nozzle. In other words, the spray axis of the nozzle 10 can be changed by changing the axis K of the center post 23. In a preferred embodiment, the axis K of the center post 23 is co-axial with the spray axis of the nozzle 10. However, the spray axis of the nozzle 10 can be offset or at some angle with respect to the K axis of the center post 23.

The annular groove 26 communicates with the housing 22 via a channel 29. This channel 29 can have an axis parallel to the K axis of the center post 23. The body 21 of the nozzle-carrier can also have a recess 27 to economize on the amount of material used for molding. On a side remote from the housing 22, the nozzle-carrier 20 can present a circularly cylindrical wall 28 juxtaposed with the cylindrical wall 42 of the pushbutton 30, as described below.

Figure 6:
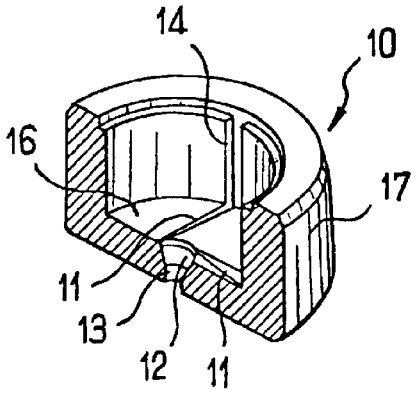
FIG. 6 is a diagrammatic perspective view showing half a nozzle according to a preferred embodiment of the present invention.

In a preferred embodiment, the nozzles 10 have swirling channels. The principle of such nozzles is well known, in particular from the article published in Volume 20 of Aerosol Age, in December 1975. Such swirling channel nozzles can be made in numerous ways. The substance that is dispensed is brought tangentially into a mixing chamber 12 by a plurality of converging channels 11, as can be seen in FIG. 6. The mixing chamber 12 communicates with the outside via an outlet orifice 13. The converging channels 11 connect with axial channels 14 that are parallel to the axis K of the nozzle. The substance is fed in channels 14 via the channel 29 of the nozzle-carrier 20. When the nozzle 11 is in place on the nozzle-carrier 20, the front face 24 of the center post 23 bears against the end wall 16 of the nozzle 10 so as to force the substance to travel along the converging channels 11.

The nozzle-carrier 20 can present an annular bead 60 in front of the center post 23 projecting radially inwards to enable the nozzle 10 to be snap-fastened in position. Where appropriate, portions in relief can be made on the side wall 17 of the nozzle 10 to improve its retention in the nozzle-carrier 20. Other coupling mechanisms between the nozzle 10 and the nozzle-carrier 20 could also be utilized in accordance with the present invention. The nozzle-carrier 20 can present a truncated angle portion 62 extending the cylindrical wall 28 beside the front face 25.

The dispenser head 3 can be manufactured as follows. After the pushbutton 30 has been unmolded together with the assembly skirt 50, the nozzle-carriers 20 fitted with the nozzles 10 are inserted through the side openings 39 until the male endpieces 38 are forced into the housings 22 and the angle portions 62 of the nozzle-carriers 20 are positioned behind the uprights 49.

Figure 8A:
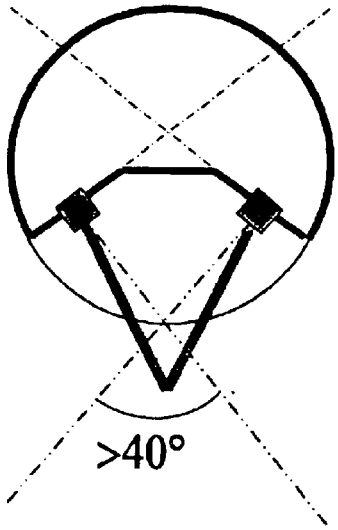
FIGS. 8A–B show top views of preferred embodiments of the present invention.
Figure 8B:
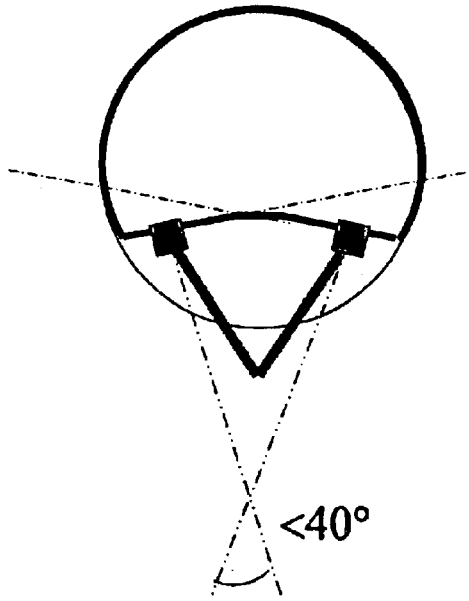

As noted above, by changing the angle of the axes K of the center posts 23, it is possible to modify the angle between the spray axes of the nozzles 10 without changing the shape of the body of the dispenser head. Such a change of angle can be made, for example, in order to adapt the dispenser head to the nature of the substance that is to be dispensed. The K axes of the center posts 23 and the spray axes of the nozzles 10 can be at a nonzero angle relative to the normals to the front walls 43, where appropriate. In other words, and as shown in FIGS. 8A–B. the spray axes of the nozzles need not be perpendicular to the front walls 43 so that the normals of the front walls 43 at the nozzle openings 41 can form a first angle and the spray axes of the nozzles 10 can form a second angle different from the first angle. In a preferred embodiment, the second angle is greater than the first angle. In another preferred embodiment, the normals of the front walls 43 at the nozzle openings 41 form an angle less than 40° and the spray axes of the nozzles 10 form an angle greater than 40°. In another embodiment, the normals of the front walls 43 at the nozzle openings form an angle greater than 40° and the spray axes of the nozzles 10 form an angle less than 40°. In another embodiment, the spray axes of the nozzles 10 form an angle between 40° and 100° with each other, for example around 60°. In yet another embodiment, the spray axes of the nozzles 10 form an angle between 60° and 100° with each other.

The angle between the axes K of the nozzles 10 can be selected as a function of the distance at which it is desired that the jets emitted by the nozzles should meet. The distance between the orifices 12 of the nozzles 10 can lie in the range of 1.5 centimeters (cm) to 2.5 cm, for example, around 2 cm. The angle between the axes K can be within the range of about 40° to about 100°, for example around 60°.

Surprisingly, using nozzles with swirling channels makes it possible to obtain a spray of particle size close to that of the initial sprays, with fragmentations or reduction of the particle sizes avoided or reduced. This result is contrary to the teaching of GB-A-2 153 444 that the encounter of the particles in the jets would give rise to fragmentation and to a reduction in particle size. The invention thus makes it possible to produce a hairspray with particles having a size that is greater than 20 micrometers ($\mu$m), for example having a mean particle size of 30 $\mu$m.

The invention is also suitable for dispensing a deodorant or other cosmetic products. The invention can also be used advantageously for dispensing substance for use on sensitive skins or on raw skin, such as a care product for treating sunburn. The invention is advantageous for treating such sensitive skin because the spray can be very soft and the substance can be dispensed without significant blowing.

The invention is not limited to the example described above. In particular, the housings receiving the nozzles can be made in a portion of the dispenser head that is stationary relative to the pressurized receptacle.

Obviously, numerous modifications and variations of the present invention are possible in light of the above teachings. It is therefore to be understood that within the scope of the appended claims, the invention may be practiced otherwise than as specifically described therein.

What is claimed as new and desired to be secured by Letters Patent of the United States is:

1. A device for dispensing a substance, comprising:

a dispenser head comprising a body defining two housings, wherein each of said housings receives a respective nozzle-carrier provided with a nozzle, wherein each of said housings communicates with the outside via a first opening along a first axis and via a second opening along a second axis, the first axis and the second axis being distinct from each other, wherein each nozzle-carrier is inserted in one of said housings via one of said first openings, and wherein after insertion each nozzle-carrier communicates with a feed duct, and wherein the substance is dispensed through said second openings.

2. A device according to claim 1, wherein said nozzles have swirling channels.

3. A device according to claim 1, wherein each feed duct, with which a nozzle-carrier communicates, opens out into a corresponding housing via a male endpiece.

4. A device according to claim 3, wherein each nozzle-carrier has a housing in which said male endpiece is engaged to form a leaktight fit.

5. A device according to claim 1, wherein each feed duct, with which a nozzle-carrier communicates, opens out into a corresponding housing via a female endpiece.

6. A device according to claim 5, wherein each nozzle-carrier has a male endpiece which engages in said female endpiece to form a leaktight fit.

7. A device according to claim 1, wherein each second opening is made in a generally plane wall.

8. A device according to claim 1, wherein each nozzle-carrier includes a truncated angle portion shaped so as to be positioned behind and in contact with an upright separating the first opening from the corresponding second opening.

9. A device according to claim 1, wherein each nozzle-carrier has a center post on which a corresponding nozzle is fixed, said center post being surrounded by an annular groove communicating via a channel with a connection portion which communicates with a feed duct.

10. A device according to claim 1, wherein each feed duct is radial.

11. A device according to claim 10, wherein each feed duct is connected to an axial duct with a female endpiece.

12. A dispenser head according to claim 1, wherein said second openings are positioned on a line which does not cross a longitudinal axis of said body.

13. A dispenser head according to claim 1, wherein said substance dispensed from each of said second openings converges at a converging point which is not on a longitudinal axis of said body.

14. A dispenser head according to claim 13, wherein said converging point and said second openings lie in a plane which is substantially perpendicular to said longitudinal axis.

15. A device for dispensing a substance, comprising:

a dispenser head comprising a body defining two housings, wherein each of said housings receives a respective nozzle-carrier provided with a nozzle, wherein each of said housings communicates with the outside via a first opening and via a second opening, wherein each nozzle-carrier is inserted in one of said housings via one of said first openings, and wherein after insertion each nozzle-carrier communicates with a feed duct, and wherein the substance is dispensed through said second openings, wherein said body comprises a pushbutton in which said housings are formed.

16. A device according to claim 15, wherein said pushbutton is connected to an assembly skirt via a hinge-forming portion.

17. A device according to claim 15, further comprising a pressurized receptacle coupled to said dispenser head.

18. A device according to claim 15, wherein said substance is a deodorant.

19. A device according to claim 15, wherein said substance is a hair product.

20. A device according to claim 15, wherein said substance is a skin care product.

21. A device for dispensing a substance, comprising:

a dispenser head comprising a body defining two housings, wherein each of said housings receives a respective nozzle-carrier provided with a nozzle, wherein each of said housings communicates with the outside via a first opening and via a second opening, wherein each nozzle-carrier is inserted in one of said housings via one of said first openings, and wherein after insertion each nozzle-carrier communicates with a feed duct, and wherein the substance is dispensed through said second openings, wherein each first opening is made in a circularly cylindrical wall.

22. A device according to claim 21, wherein each nozzle-carrier has a circularly cylindrical wall portion.

23. A device for dispensing a substance, comprising:

a dispenser head comprising a body defining two housings, wherein each of said housings receives a respective nozzle-carrier provided with a nozzle, wherein each of said housings communicates with the outside via a first opening and via a second opening, wherein each nozzle-carrier is inserted in one of said housings via one of said first openings, and wherein after insertion each nozzle-carrier communicates with a feed duct, and wherein the substance is dispensed through said second openings, wherein each first opening is a side opening and each second opening is a front opening.

24. A dispenser head, comprising:

a body defining two housings and comprising two feed ducts and two dispensing openings, a first opening communicating with the outside along a first axis;

two nozzle-carriers, each of said nozzle-carriers being in one of said housings and coupled to one of said feed ducts; and two nozzles, each of said nozzles being coupled to one of said nozzle-carriers, wherein said each of said nozzle-carriers is removable from said one of said housings via a second opening in said body, said second opening in said body communicating with the outside along a second axis distinct from the first axis.

25. A dispenser head according to claim 24, wherein said nozzles have spray axes which form an angle between 40° and 100° with each other.

26. A dispenser head according to claim 24, wherein said nozzles are positioned on a line which does not cross a longitudinal axis of said body.

27. A dispenser head according to claim 24, wherein said nozzles have spray axes that converge at a converging point which is not on a longitudinal axis of said body.

28. A dispenser head according to claim 27, wherein said converging point and said nozzles lie in a plane which is substantially perpendicular to said longitudinal axis.

29. A dispenser head according to claim 24, wherein a peripheral wall of said body is generally cylindrical about a longitudinal axis of said body.

30. A dispenser head, comprising:

a body defining two housings, comprising two feed ducts;

two nozzle-carriers, each of said nozzle-carriers being in one of said housings and coupled to one of said feed ducts; and two nozzles, each of said nozzles being coupled to one of said nozzle-carriers, wherein said each of said nozzle-carriers is removable from said one of said housings via an opening, wherein said body comprises a pushbutton defining said housings and said openings.

31. A dispenser head according to claim 30, wherein said pushbutton is pushable along an axial direction.

32. A dispenser head according to claim 31, wherein each of said nozzle-carriers defines a channel in a plane perpendicular to said axial direction.

33. A dispenser head according to claim 32, wherein each of said nozzles defines an orifice in communication with said channel.

34. A dispenser head according to claim 33, wherein said channel communicates with an axial duct.

35. A dispenser head according to claim 34, wherein said channel is coupled to said axial duct via a feed duct.

36. A dispenser head according to claim 35, wherein said feed duct has a male endpiece engaged in said nozzle-carrier.

37. A dispenser head according to claim 30, wherein said nozzles have swirling channels.

38. A dispenser head, comprising:

a body defining two housings and comprising two feed ducts;

two nozzle-carriers, each of said nozzle-carriers being inserted in one of said housings via a carrier opening, said carrier opening in said body being distinct from the feed ducts;

two nozzles, each of said nozzles being coupled to one of said nozzle-carriers, wherein said body comprises a top surface, a bottom surface, and a first wall between said top and bottom surfaces and defining two nozzle openings exposing said nozzles.

39. A dispenser head according to claim 38, wherein said first wall comprises at least two portions, each of said portions defining one of said nozzle openings.

40. A dispenser head according to claim 38, wherein said nozzles have spray axes which form an angle between 40° and 100° with each other.

41. A dispenser head according to claim 38, wherein said nozzles have spray axes which form an angle between about 60° and 100° with each other.

42. A dispenser head according to claim 38, wherein said body further comprises a second wall between said top and bottom surfaces and defining two carrier openings for said nozzle-carriers.

43. A dispenser head according to claim 42, wherein each of said nozzle-carriers is removable from one of said housings through one of said carrier openings.

44. A dispenser head according to claim 42, wherein each of said nozzle-carriers has a cylindrical wall exposed by one of said carrier openings.

45. A dispenser head according to claim 38, wherein said top surface has a shape of a first section of a disk.

46. A dispenser head according to claim 45, wherein said bottom surface has a shape of a second section of said disk, said first and second sections being complementary.

47. A dispenser head according to claim 38, wherein said first wall is perpendicular to said top and bottom surfaces.

48. A dispenser head according to claim 38, wherein said top and bottom surfaces are parallel to each other.

49. A dispenser head according to claim 38, wherein a peripheral wall of said body is cylindrical about an axis of said body.

50. A dispenser head according to claim 38, wherein said body comprises a pushbutton defining said housings.

51. A dispenser head according to claim 38, wherein said body has a longitudinal axis and said carrier openings do not face said longitudinal axis.

52. A dispenser head according to claim 51, wherein said carrier openings are positioned on a line which does not cross said longitudinal axis of said body.

53. A dispenser head according to claim 51, wherein said substance dispensed from each of said carrier openings converges at a converging point which is not on said longitudinal axis.

54. A dispenser head according to claim 51, wherein said converging point and said carrier openings lie in a plane which is substantially perpendicular to said longitudinal axis.

55. A dispenser head, comprising:

a body defining two housings;

two nozzle-carriers, each of said nozzle-carriers being inserted in one of said housings via a carrier opening;

two nozzles, each of said nozzles being coupled to one of said nozzle-carriers, wherein said body comprises a top surface, a bottom surface, and a first wall between said top and bottom surfaces and defining two nozzle openings exposing said nozzles, wherein said first wall comprises at least two portions, each of said portions defining one of said nozzle openings, wherein normals of said portions at said nozzle openings form a first angle, and said nozzles have spray axes which form a second angle different from said first angle.

56. A dispenser head according to claim 55, wherein said second angle is greater than said first angle.

57. A dispenser head according to claim 55, wherein said first angle is less than 40° and said second angle is greater than 40°.

58. A disencer head according to claim 55, wherein said first angle is greater than 40° second angle is less than 40°.

59. A dispenser head, comprising:

a body defining two housings;

two nozzle-carriers, each of said nozzle-carriers being inserted in one of said housings via a carrier opening;

two nozzles, each of said nozzles being coupled to one of said nozzle-carriers, wherein said body comprises a top surface, a bottom surface, and a first wall between said top and bottom surfaces and defining two nozzle openings exposing said nozzles, wherein said first wall comprises at least two portions, each of said portions defining one of said nozzle openings, and wherein normals of said portions at said nozzle openings form an angle between 40° and 100°.

60. A dispenser head, comprising:

a body defining two housings;

two nozzle-carriers, each of said nozzle-carriers being inserted in one of said housings via a carrier opening;

two nozzles, each of said nozzles being coupled to one of said nozzle-carriers, wherein said body comprises a top surface, a bottom surface, and a first wall between said top and bottom surfaces and defining two nozzle openings exposing said nozzles, wherein said body further comprises a second wall between said top and bottom surfaces and defining two carrier openings for said nozzle-carriers, and wherein said second wall is cylindrical about an axis of said body.

61. A dispenser head according to claim 60, wherein said carrier openings are diametrically opposed to each other.

62. A dispenser head, comprising;

a pushbutton defining two housings;

two nozzle-carriers, each of said nozzle-carriers being inserted in one of said housings via a carrier opening formed on a periphery of said pushbutton;

two nozzles, each of said nozzles being coupled to one of said nozzle-carriers, wherein said pushbutton comprises a recessed portion defining two nozzle openings, each of said nozzle openings exposing one of said nozzles.

* * * * *

UNITED STATES PATENT AND TRADEMARK OFFICE

CERTIFICATE OF CORRECTION

PATENT NO. : 6,824,077 B2
DATED : November 30, 2004
INVENTOR(S) : Vincent De Laforcade It is certified that error appears in the above-identified patent and that said Letters Patent is hereby corrected as shown below:

Column 10,
Line 13, change “disencer” to -- dispenser --.

Signed and Sealed this

Thirteenth Day of September, 2005

JON W. DUDAS
*Director of the United States Patent and Trademark Office*